United States Patent [19]

Mitchell

[11] Patent Number: 4,985,875

[45] Date of Patent: Jan. 15, 1991

[54] ENGINE OPERATING TIME HOUR METER

[75] Inventor: Paul Mitchell, Glenview, Ill.

[73] Assignee: ENM Company, Chicago, Ill.

[21] Appl. No.: 431,470

[22] Filed: Nov. 3, 1989

[51] Int. Cl.[5] ..... G04F 8/00

[52] U.S. Cl. ..... 368/5; 368/8; 377/16

[58] Field of Search ..... 368/115, 619, 101, 107–113; 364/431.05, 431.06, 569; 290/34, 35; 377/16, 20

[56] References Cited

U.S. PATENT DOCUMENTS

| | | | |
|---|---|---|---|
| 3,182,440 | 5/1965 | Widegren | 368/9 |
| 3,256,685 | 6/1966 | Siewert | 368/9 |
| 3,299,627 | 1/1967 | Hart et al. | 368/5 |
| 3,479,815 | 11/1969 | Prindell, Jr. et al. | 58/145 |
| 3,792,445 | 2/1974 | Bucks et al. | 340/172.5 |
| 3,854,281 | 12/1974 | Reichert | 368/9 |
| 3,948,039 | 4/1976 | Leveraus | 368/9 |
| 3,965,669 | 6/1976 | Larson et al. | 368/9 |
| 4,049,952 | 9/1977 | Forsslund | 235/92 T |
| 4,180,724 | 12/1979 | Councilman et al. | 235/92 T |
| 4,395,624 | 7/1983 | Wartski | 377/15 |
| 4,478,521 | 10/1984 | Evans et al. | 368/8 |
| 4,501,005 | 2/1985 | Miller | 377/20 |
| 4,534,045 | 8/1985 | Collier | 377/16 |
| 4,612,655 | 9/1986 | Nakamura | 377/16 |
| 4,630,292 | 12/1986 | Juricich et al. | 377/20 |

*Primary Examiner*—Vit W. Miska

*Attorney, Agent, or Firm*—Mason, Kolehmainen, Rathburn & Wyss

[57] ABSTRACT

An engine operating time measuring apparatus is provided for use with an engine having an internal magneto-type electrical generator providing an ignition voltage. The engine operating time measuring apparatus includes power supply circuitry coupled to the electrical generator of the monitored engine for supplying operating power to the apparatus in response to generated ignition voltage. Timing circuitry is responsive to the operating power supplying circuitry for generating a clock signal. A counter is responsive to the clock signal for counting the generated clock signal to identify the engine operating time.

12 Claims, 1 Drawing Sheet

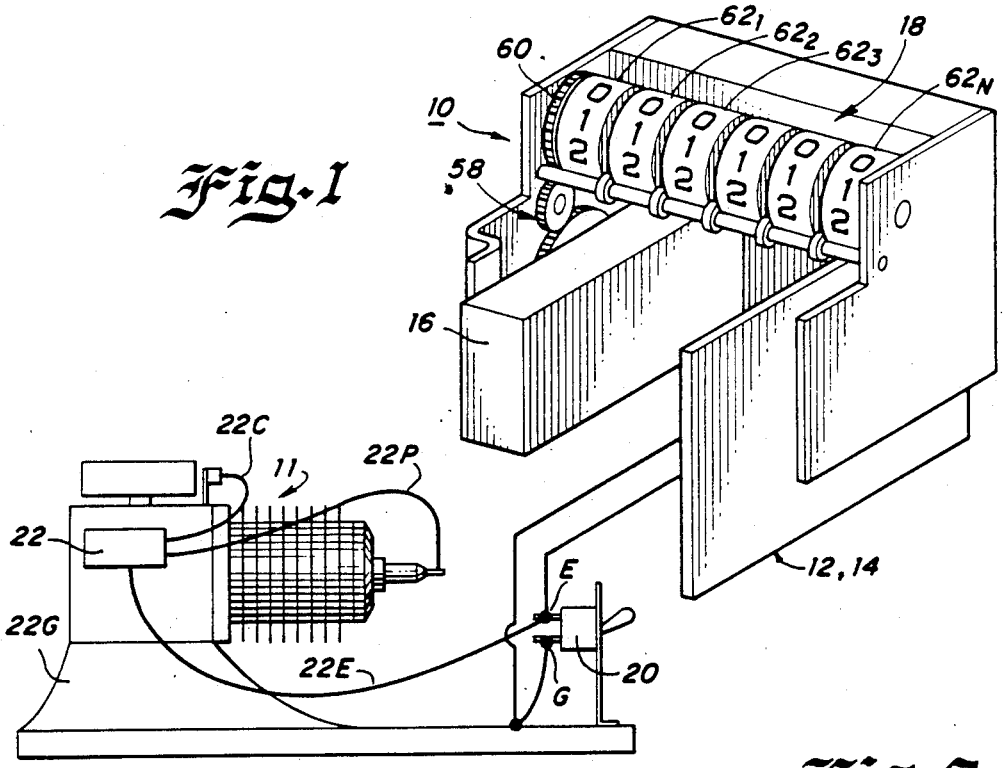
Fig. 1
60
$62_1$
$62_2$
$62_3$
18
$62_N$
10
58
16
22C
11
22P
22
22G
E
22E
G
20
12, 14
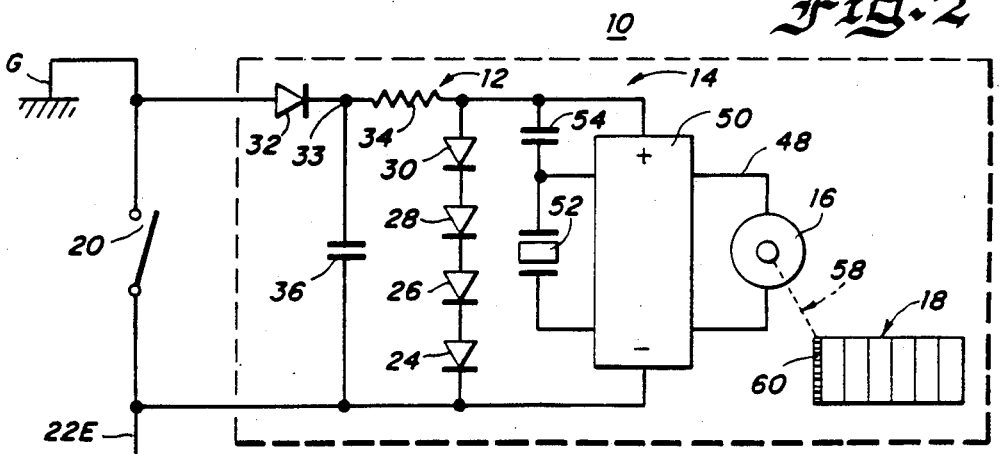
Fig. 2
10
G
12
14
32
33
34
30
28
26
24
36
54
52
50
48
16
58
18
60
20
22E
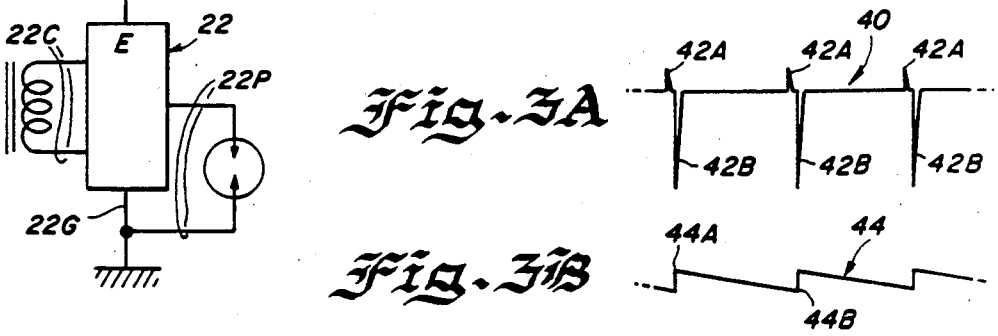
22C
E
22
22P
22G
Fig. 3A
40
42A
42B
Fig. 3B
44A
44
44B

ENGINE OPERATING TIME HOUR METER

BACKGROUND OF THE INVENTION

1. Field of the Invention

The present invention relates to hour meters for recording the operating time of monitored engines, and more particularly to an improved engine operating time recording apparatus having operating power completely derived from an internal magneto-type electrical generator of a monitored engine.

2. Description of the Prior Art

Hour meters are commonly used to measure the running or operating time of various equipment for scheduling preventive maintenance. Disadvantages of known mechanical hour meters include the imprecise recording of time and unreliability. Other known hour meters for recording the operating time of monitored engines utilize a battery direct current (DC) source, as is available in many vehicles such as automobiles. Alternatively known hour meters use an alternating current (AC) source. However, an AC source or a battery is not included with many small engine applications, such as in lawn mowers or pumps.

In small engine applications, typically an electronic ignition control system is used in conjunction with an internal magneto-type electrical generator of the engine. For example, the ignition control system can be operatively positioned adjacent a flywheel of the engine being controlled. The ignition control system provides a high voltage, such as in a secondary winding of an ignition coil, to fire a spark plug or spark plugs associated with the engine. Typically the engine flywheel carries a permanent magnet that energizes a stator core of the ignition control system upon rotation of the flywheel for generating various electrical control pulses.

It is desirable to provide an hour meter for recording the operating time of small engines that is completely powered by an internal magneto-type electrical generator of a monitored engine and that is reliable and accurate.

SUMMARY OF THE INVENTION

Among the important objects of the present invention are to provide an improved hour meter for recording the operating time of a monitored engine; to provide such an hour meter that is a simple arrangement and economical to manufacture; and to provide such an hour meter that overcomes many of the disadvantages of known hour meters.

In brief, the objects and advantages of the present invention are achieved by an engine operating time measuring apparatus for use with an engine having an internal magneto-type electrical generator providing an ignition voltage. The engine operating time measuring apparatus includes power supply circuitry coupled to the electrical generator of the monitored engine for supplying operating power to the apparatus. Timing circuitry is responsive to the operating power supplying circuitry for generating a clock signal. A counter is responsive to the clock signal for counting the generated clock signal to identify the engine operating time.

In accordance with a feature of the invention, the operating power for the engine operating time measuring apparatus or hour meter is completely derived from the monitored engine. The power supply circuitry includes a charging capacitor for storing energy in response to induced voltages resulting, for example, from a rotating magnetic field of the monitored engine. A crystal controlled oscillator circuit and a stepping motor can be included in the timing circuitry for generating a clock movement signal that is applied to a mechanical counter.

BRIEF DESCRIPTION OF THE DRAWINGS

The present invention together with the above and other objects and advantages may best be understood from the following detailed description of the embodiment of the invention illustrated in the drawings, wherein:

FIG. 1 is a side elevational view of an engine powered hour meter arranged in accordance with the invention together with a conventional engine being monitored;

FIG. 2 is an electrical schematic diagram representation of the engine powered hour meter of FIG. 1; and FIGS. 3A and 3B are exemplary voltage waveforms to illustrate how operating power is derived from the monitored engine.

DETAILED DESCRIPTION OF THE PREFERRED EMBODIMENT

Referring now to the drawings, in FIG. 1 there is illustrated an engine powered hour meter arranged in accordance with the principles of the present invention and designated as a whole by the reference character 10. A conventional engine 11 is shown with the engine powered hour meter 10, although it should be understood that the engine powered hour meter 10 advantageously can be used for various applications with any engine having an internal magneto-type electrical generator.

Referring also to FIG. 2, there is shown a schematic diagram representation of the engine powered hour meter 10. Among its primary components, the engine powered hour meter 10 includes an operating power supply circuit 12 for providing DC operating power to the meter 10 when the monitored engine 11 is operating, a crystal controlled oscillator circuit 14 operatively connected to the power supply circuit 12 for providing a stable predetermined frequency signal or clock signal, a motor 16 for providing a clock movement signal in response to the clock signal output of the oscillator circuit 14 and a mechanical counter 18 operatively driven by the clock movement signal of motor 16.

A parallel combination of the operating power supply circuit 12 and an engine enable switch 20 energizes the operating power supply circuit 12 when the engine 11 is operating. Engine enable switch 20 is connected between ground potential indicated at a line G and an enable input E of an electronic ignition control module 22 used in conjunction with the monitored engine 11. The electronic ignition control module 22 includes conventional connections to a spark plug indicated by 22P, an ignition coil indicated by 22C, the engine enable switch 20 indicated by 22E and ground potential indicated by 22G.

With the engine enable switch 20 opened, then engine 11 can operate. Engine 11 can be stopped by closing the engine enable switch 20 so that the enable input E is connected to ground potential G. The operating power supply circuit 12 includes a plurality of diodes 24, 26, 28, 30 and 32 coupled in series across the engine enable switch 20, a current limiting resistor 34 series-connected between diodes 30 and 32, and a charging capacitor 36 connected between a junction 33 of diode 32 and resistor 34 and the enable input E of an electronic ignition module 22. Diode 32 is arranged cathode to anode between the junction 33 and ground potential G to provide the proper polarity of power to an integrated circuit oscillator device 50.

FIG. 3A illustrates a typical voltage waveform generally designated by 40 at a circuit point corresponding to the enable input E when the engine 11 is operating. The voltage waveform 40 includes a periodic positive and negative pulse 42A and 42B, for example, corresponding to an ignition firing signal. Typically the positive pulse 42A is used to fire a spark plug associated with the monitored engine 11 and the negative pulse 42B is unused in conventional operation of the engine 11.

In accordance with an important aspect of the present invention, an operating power supply for the hour meter 10 is derived from an ignition firing signal, such as the periodic negative pulses 42B. In operation, the periodic negative pulses 42B are applied via the series connected diodes 24, 26, 28, 30, 32 and resistor 34 for charging the energy storage capacitor 36. A reference voltage level of approximately 2.8 volts is provided by the series connected diodes 24, 26, 28, 30.

FIG. 3B provides a graphical representation of the voltage waveform generally designated by 44 corresponding to the voltage across the series connected diodes 24, 26, 28, 30. Voltage waveform 44 has a peak voltage level indicated by 44A of approximately 2.8 volts generally coinciding with the charging pulses 42B of waveform 40 in FIG. 3A. Voltage waveform 44 has a minimum voltage level indicated by 44B of approximately 2.2 volts representing the discharge of the energy storage capacitor 36 between the charging pulses 42B with the engine 11 operating.

The crystal controlled oscillator circuit 14 is energized responsive to the voltage waveform 44 of the power supply circuit 12 to provide a stable clock signal at a line 48. Oscillator circuit 14 includes the integrated circuit oscillator device 50 arranged for providing, for example, a 1 Hz bipolar drive signal at its output 48 used to directly drive motor 16. Coupled to the integrated circuit oscillator device 50 are an external crystal 52 having a selected resonant operating frequency, such as a 37.768 KHz, and a trimmer capacitor 54. Various commercially available devices having low power consumption characteristics, such as a CMOS integrated circuit device type CD22777, manufactured and sold by RCA Corp., can be used for the integrated circuit oscillator device 50.

Motor 16 advantageously is provided by a stepping motor having low power consumption characteristics. The 1 Hz bipolar drive signal at line 48 is applied to directly drive the motor 16. An output of one revolution per two drive the motor 16. An output of one revolution per two second time interval or 30 RPM (revolutions per minute) is provided with the applied 1 Hz bipolar drive signal and the motor 16 having a rated step of 180 degrees. A gear train assembly 58 adjusts the frequency of the motor drive movement to provide a selected frequency drive movement indicated at a line 60 that is applied to the mechanical counter 18.

Referring again to FIG. 1, mechanical counter 18 is operatively driven by the motor 16 via the gear train assembly 58. Mechanical counter 18 includes a plurality of dial display elements $62_1$–$62_N$, together indicative of cumulative operating time for the engine 11. For example, each incremental movement of the dial display element $62_1$ can indicate 1/10 hour, $62_2$ indicating 1 hour increments and being incremented one time after 10 increments or one complete rotation of display element $62_1$. This action continues for each of the sequential dial display elements through display element $62_N$ included in the counter 18.

While the invention has been described with reference to details of the illustrated embodiment, these details are not intended to limit the scope of the invention as defined in the appended claims.

I claim:

1. An engine operating time measuring apparatus for use with an engine having an internal magneto-type electrical generator providing an ignition voltage, said apparatus comprising:

means connected to the internal magneto-type electrical generator of the monitored engine for supplying operating power to said apparatus; said operating power supplying means being connected in parallel across an engine enable switch; said engine enable switch being connected between ground potential and an enable input of an electronic ignition module of the monitored engine; said operating power supplying means deriving operating power completely from the internal magneto-type electrical generator of the monitored engine;

timing means responsive to said operating power supplying means for generating a clock signal; and counter means responsive to said clock signal for counting said generated clock signal to identify the engine operating time.

2. An engine operating time measuring apparatus as recited in claim 1 wherein said operating power supplying means include a charging capacitor for storing energy in response to the ignition voltage of the monitored engine.

3. An engine operating time measuring apparatus as recited in claim 2 further including a plurality of diodes, said diodes connected back-to-back in series across said capacitor for establishing a reference voltage amplitude across said capacitor.

4. An engine operating time measuring apparatus as recited in claim 1 wherein said timing means include a crystal controlled oscillator circuit for generating said clock signal.

5. An engine operating time measuring apparatus as recited in claim 1 further including a motor drive means for generating a clock movement responsive to said clock signal.

6. An engine operating time measuring apparatus as recited in claim 5 wherein said counter means is a mechanical counter responsive to said clock movement to indicate the engine operating time.

7. An engine operating time measuring apparatus for use with an engine having an internal magneto-type electrical generator providing periodic ignition pulses, said apparatus comprising:

means coupled to the electrical generator of the monitored engine for supplying operating power to said apparatus, said operating power supplying means being connected in parallel across an engine enable switch; said engine enable switch being connected between ground potential and an enable input of an electronic ignition module of the monitored engine; said operating power supplying means deriving operating power completely from the internal magneto-type electrical generator of the monitored engine; said operating power supplying means including a charging capacitor for storing energy responsive to said periodic ignition pulses;

timing means responsive to said operating power supplying means for generating a clock signal; and counter means responsive to said clock signal for counting said generated clock signal to identify the engine operating time.

8. An engine operating time measuring apparatus as recited in claim 7 further including a plurality of diodes arranged to establish a reference voltage amplitude across said capacitor.

9. An engine operating time measuring apparatus as recited in claim 7 wherein said timing means include a crystal controlled oscillator circuit for generating said clock signal.

10. An engine operating time measuring apparatus as recited in claim 7 further including a motor drive means for generating a clock movement responsive to said clock signal.

11. An engine operating time measuring apparatus as recited in claim 10 wherein said counter means is a mechanical counter responsive to said clock movement to indicate the engine operating time.

12. An engine operating time hour meter for use with an engine having an internal magneto-type electrical generator generating an ignition voltage, said apparatus comprising:

charging capacitance means coupled to the electrical generator of the monitored engine for storing energy and for supplying operating power to said apparatus in response to said generated ignition voltage; said operating power supplying means being connected in parallel across an engine enable switch; said engine enable switch being connected between ground potential and an enable input of an electronic ignition module of the monitored engine; said operating power supplying means deriving operating power completely from the internal magneto-type electrical generator of the monitored engine;

timing means responsive to said operating power supplying means for generating a clock signal;

motor drive means responsive to said clock signal for generating a clock movement; and counter means responsive to said clock movement for indicating the engine operating time.

* * * * *